United States Patent [19]

Ishino

[11] Patent Number: 4,937,484

[45] Date of Patent: Jun. 26, 1990

[54] SPARKING PLUG

[75] Inventor: Yasutake Ishino, Kariya, Japan

[73] Assignee: Nippondenso Co., Ltd., Kariya, Japan

[21] Appl. No.: 194,207

[22] Filed: May 16, 1988

[51] Int. Cl.[5] ..... H01T 13/36

[52] U.S. Cl. ..... 313/143

[58] Field of Search ..... 313/130, 131 A, 137, 313/141, 142, 143

[56] References Cited

U.S. PATENT DOCUMENTS 4,427,914 1/1984 Mizuno et al. ..... 313/130

FOREIGN PATENT DOCUMENTS 51-38855 10/1976 Japan .
61-48225 10/1986 Japan .
62-46958 10/1987 Japan .

OTHER PUBLICATIONS

A Handbook of the Oil and Fats Chemical Products—A. Musuda & Editing Committee, pp. 403, 404 and rear page—Daily Industrial Press—Tokyo—Pub'd Oct. 30, 1963.

*Primary Examiner*—Sandra O'Shea
*Attorney, Agent, or Firm*—Cushman, Darby & Cushman

[57] ABSTRACT

A coating layer made of a heat-proof insulating material is formed on the surface of a leg, exposed to the interior of the engine, of a ceramic insulator of a sparking plug. The coating is formed of a mixed solution of silicone oil blended with a mixture of parafin and ozokerite. The mixed solution contains 100 weight percent of silicone oil blended with paraffin by at least 5 weight percent and ozokerite by at least 0.2 weight percent.

8 Claims, 4 Drawing Sheets

SPARKING PLUG

BACKGROUND OF THE INVENTION

1. FIELD OF THE INVENTION

This invention relates to improvements in sparking plugs and more particularly to a sparking plug having an improved contamination-proof capability.

2. DESCRIPTION OF THE RELATED ART

During an initial term before new cars are offered for sale to users, the engine of the new cars is usually trained repeatedly through conditioning running or short-time running in the condition of low-speed and low-load. The sparking plug has a ceramic insulator which has a leg exposed to the interior of the engine and during the training, the leg of the sparking plug mounted to the engine of a new car is contaminated with such a substance as carbon so that the sparking plug tends to undergo a failure to ignite. In order to guard the sparking plug against this type of initial contaminative damage, it has hitherto been practiced that a heat-proof insulating material is provided on the surface of the leg of the ceramic insulator exposed to the interior of the engine with the view of preventing leakage of current from the surface of the ceramic insulator leg to a metal body of the sparking plug.

In conventionally known techniques, the heat-proof insulating material is formed by applying, for example, silicone oil on the inner surface of the metal body and on the surface of the ceramic insulator leg (Japanese Patent Publication No. 51-38855) or by applying on the surface of the ceramic insulator leg a coating layer made of, for example, a mixture of silicone oil and paraffin or a mixed solution of fluorine system oil and a solution containing paraffin (Japanese Patent Publication Nos. 61-48225 and 62-46958).

Disadvantageously, however, the silicone oil has low viscosity and high fluidity and therefore the silicone oil or the coating layer formed of the mixture of silicone oil and paraffin, applied on the surface of the ceramic insulator leg by an amount necessary to fulfil the insulating effect, droops by its own weight and partly stays to bridge spark areas defining the spark gap of the sparking plug. Under these circumstances, the present inventors have found that when voltage is applied to the sparking plug having the spark areas bridged by the staying silicone oil in order to cause the spark areas to spark, the bridging silicone oil is carbonized by spark discharge energy and becomes electrically conductive to override the spark, ultimately giving rise to a failure to ignite the sparking plug.

SUMMARY OF THE INVENTION

An object of the invention is to provide a sparking plug which can prevent silicone oil from drooping toward the spark areas defining the spark gap of the sparking plug and can efficiently guard against the contaminative damage.

According to the invention, in a sparking plug having a ceramic insulator holding a center electrode and a metal body in which the ceramic insulator is fixedly housed, a coating layer formed of a mixed solution of silicone oil blended with a mixture of paraffin and ozokerite is formed on at least the surface of a leg of the ceramic insulator, the leg being surrounded by the inner surface, close to the combustion chamber, of the metal body.

To attain the intended effect, the mixed solution must consist of silicone oil, at least 5 weight percent of paraffin and at least 0.2 weight percent of ozokerite when whole weight of silicon oil is regarded as 100 weight percent.

When silicone oil is blended with paraffin and ozokerite, crystals of the paraffin are formed into minute particles by the action of the ozokerite and the minute particles of paraffin crystals are dispersed in the silicone oil. The minute paraffin crystals then behave as if they are a chain in the silicone oil, thereby suppressing the fluidity of the silicone oil.

Even silicone oil mixed with paraffin alone can suppress fluidity of the silicone oil but its ability to suppress the fluidity of the silicone oil is extremely inferior to that of the mixture containing the ozokerite in addition to the paraffin.

By blending the silicone oil with proper amounts of paraffin and ozokerite in the manner described as above, the fluidity of the silicone oil can be suppressed and the mixed solution can be prevented from drooping by its own weight.

DESCRIPTION OF THE PREFERRED EMBODIMENTS

The invention will now be described by way of example with reference to the accompanying drawings.

Figure 1:
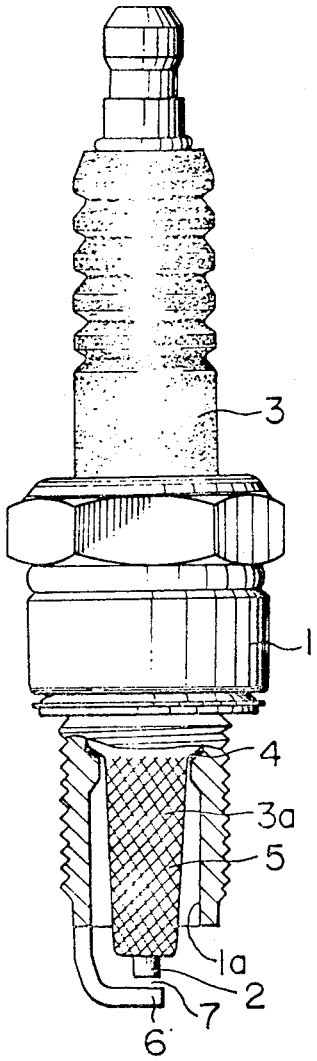
FIG. 1 is a partly sectioned view illustrating a sparking plug according to an embodiment of the invention.

Referring to FIG. 1, a sparking plug comprises a metal body 1 having a threaded portion through which the sparking plug is mounted to the engine, a center electrode 2, and a ceramic insulator 3 of high alumina property in which the center electrode 2 is held. The insulator 3, along with intervention of a gasket 4, is fixedly housed in the metal body 1. The inner surface 1*a*, close to the combustion chamber, of the metal body 1 defines an inner cavity into which a leg 3*a* of the insulator 3 protrudes, and a coating layer 5 is formed on the surface of the leg 3*a* in accordance with teachings of the present invention. An earth electrode 6 connected to the lower end surface of the metal body 1 opposes the lower end of the center electrode 2 to define a spark gap 7. If desired, a coating layer 5 may also be formed on the inner surface 1*a*, close to the combustion chamber, of the metal body 1 in accordance with teachings of the present invention.

The coating layer 5 is formed of a non-fluidizing mixed solution containing silicone oil blended with a mixture of paraffin and ozokerite. Paraffin and ozokerite are detailed in a reference book of fat and fatty oil chemical products published by NIKKAN KOGYO SHINBUN SHA.

(I) Test on Mixing Percentage of Ozokerite to Paraffin

Firstly, for the purpose of grasping a proper mixing percentage of ozokerite to paraffin, five kinds of test mixture samples were prepared by mixing 100 percent in weight of solid paraffin (hereinafter simply referred to as paraffin) with ozokerite at different percentages of 5%, 10%, 20%, 30% and 40% in weight, and five kinds of mixed solutions a, b, c, d, and e were prepared by blending 100 weight percent of silicone oil with each of the five mixture samples at a percentage of 10% in weight. Fluidity of the thus prepared mixed solutions was examined.

In the test, a product number 125 named "paraffin wax" of NIPPON SEIRO (Japanese corporation) was used as the paraffin, a product number 130 named "ozokerite" of NIPPON Wax (Japanese corporation) as the ozokerite and a product number KF 96 named "dimethyl polysiloxane" of SHINETSU KAGAKU KOGYO (Japanese corporation) as the silicone oil. It is noted that in the succeeding tests, the same paraffin, ozokerite and silicone oil as above were used.

In preparing the mixed solution, a mixture of paraffin, ozokerite and silicone oil was dissolved in a solvent and blended sufficiently and thereafter the resulting solution was heated to remove the solvent by evaporation. As the solvent, tetrachlorodifluoro ethane was used. The mixed solution used in the succeeding tests was prepared in the same manner as above.

Figure 2:
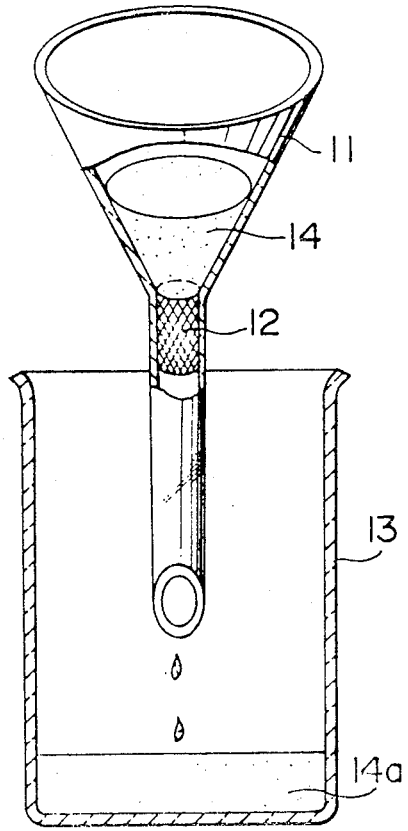
FIG. 2 is a perspective view illustrating an instrument for measuring fluidity.

Fluidity was then measured with an instrument as illustrated in FIG. 2. The instrument has a funnel 11, a filter 12 and a beaker 13 and it measures fluidity of a test liquid 14 in terms of time required for 90% of 10 grams of the test liquid to pass through the filter 12 at 20° C. The test liquid 14 passing through the filter 12 pools in the beaker 13, as illustrated at 14*a* in FIG. 2. Specifically, the filter 12 used in the measurement had meshes by which it took 24 hours for 90 percent of silicone oil of 1000 c/s viscosity to pass through the filter 12.

Figure 3:
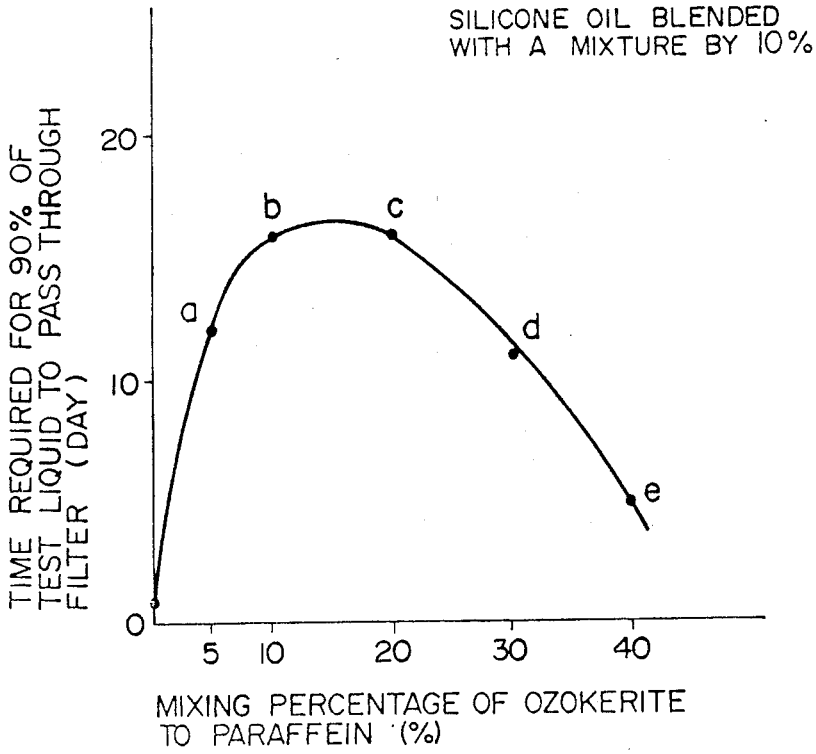
FIGS. 3 and 4 are graphs comparatively illustrating values representative of fluidity of various mixed solutions.

Measurement results are graphically illustrated in FIG. 3, demonstrating that fluidity of the silicone oil can be suppressed most efficiently at a mixing percentage of about 15% of the ozokerite to the paraffin.

(II) Test on Blending Percentage of Mixture Containing Paraffin and Ozokerite to Silicone Oil A mixture was prepared by mixing the paraffin with the ozokerite at the 15% mixing percentage which was proven to be efficient in the test of (I), and four kinds of mixed solution test samples $T_1$, $T_2$, $T_3$ and $T_4$ were prepared by blending 100 weight percent of silicone oil with the mixture at different percentages of 10%, 20%, 30% and 40% in weight. For comparison, four kinds of mixed solution test samples $P_1$, $P_2$, $P_3$ and $P_4$ were prepared by blending 100 weight percent of silicone oil with paraffin alone at similarly different percentages of 10%, 20%, 30% and 40% in weight. Fluidity of these test samples was examined through the measurement described previously.

Figure 4:
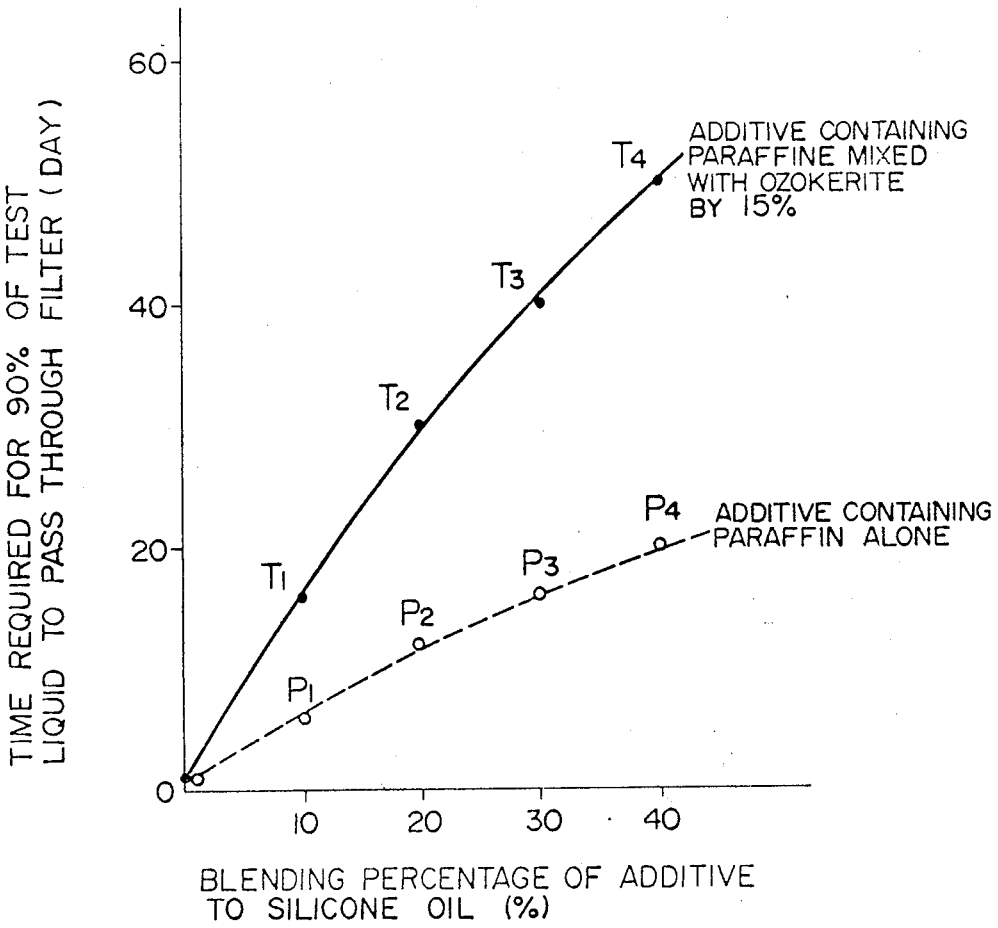

Measurement results are graphically illustrated in FIG. 4, demonstrating that the mixed solution containing silicone oil blended with, the mixture of paraffin and ozokerite has the fluidity suppressing effect which is extremely superior to that of the mixed solution containing silicone oil blended with paraffin alone.

Thus, it is concluded from the above tests of (I) and (II) that by blending, at a percentage of 5% or more in weight, 100 weight percent of silicone oil with the mixture of 100 weight percent of paraffin and ozokerite mixed thereto at a percentage of 5 to 30% in weight, the fluidity of the silicone oil can be suppressed sufficiently. Preferably, 100 weight percent of silicone oil may be blended, at a percentage of 10 to 30% in weight, with the mixture of 100 weight percent of paraffin mixed with ozokerite at a percentage of 10 to 20% in weight so as to maintain high contamination-proof capability of the sparking plug as will be described later.

When converting the mixing percentage of mixture content into values referenced to 100 weight percent of the silicone oil, the paraffin content is at least 5% in weight and the ozokerite content is at least 0.2% in weight within 100 weight percent of silicone oil in order that the effect of suppressing the fluidity can fulfil itself efficiently. From the standpoint of contamination-proof capability, 100 weight percent of silicone oil is desirably blended with the paraffin at a percentage of 10 to 30% in weight and the ozokerite at a percentage of 1 to 6% in weight.

(III) Experiment Necessary for Evaluating Carbon Contamination-Proof Capability

Sparking plug samples each having the coating layer 5 formed on the leg 3*a* of ceramic insulator 3 as illustrated in FIG. 1 were prepared and evaluated for their carbon contamination-proof capability.

This experiment was conducted by repeating one cycle of running of a four-cycle, four-cylinder and 2000 CC—displacement engine under a test condition that throughout the one cycle running, racing was effected three times by covering idling (800 r.p.m) and ultimate throttle full open, and thereafter acceleration/deceleration to change the car speed between 10 Km/H and 20 Km/H was effected for one minute.

In accordance with teachings of the present invention, a mixed solution $T_1$, as indicated in FIG. 4 in which 100 weight percent of silicone oil blended at a percentage of 10% with a mixture of 100 weight percent of paraffin mixed with ozokerite at a percentage of 15%, was applied by 5 mg as the coating layer to prepare a sparking plug sample A, and was coated by 15 mg (the limiting amount of coating on the leg 3*a*) to prepare a sparking plug sample B. A mixed solution $P_3$ containing 100 weight percent of silicone oil blended with the paraffin alone at a percentage of 30% (having the same fluidity as the aforementioned mixed solution $T_1$) was coated by 5 mg to prepare a comparative sparking plug sample C, and was coated by 15 mg to prepare a comparative sparking plug sample D. Further, the silicone oil alone was coated by 5 mg (the limiting amount of coating on the leg 3*a* because of its fluidity) to prepare a comparative sparking plug sample E and no silicone oil was coated to prepare a comparative sparking plug sample F.

Figure 5:
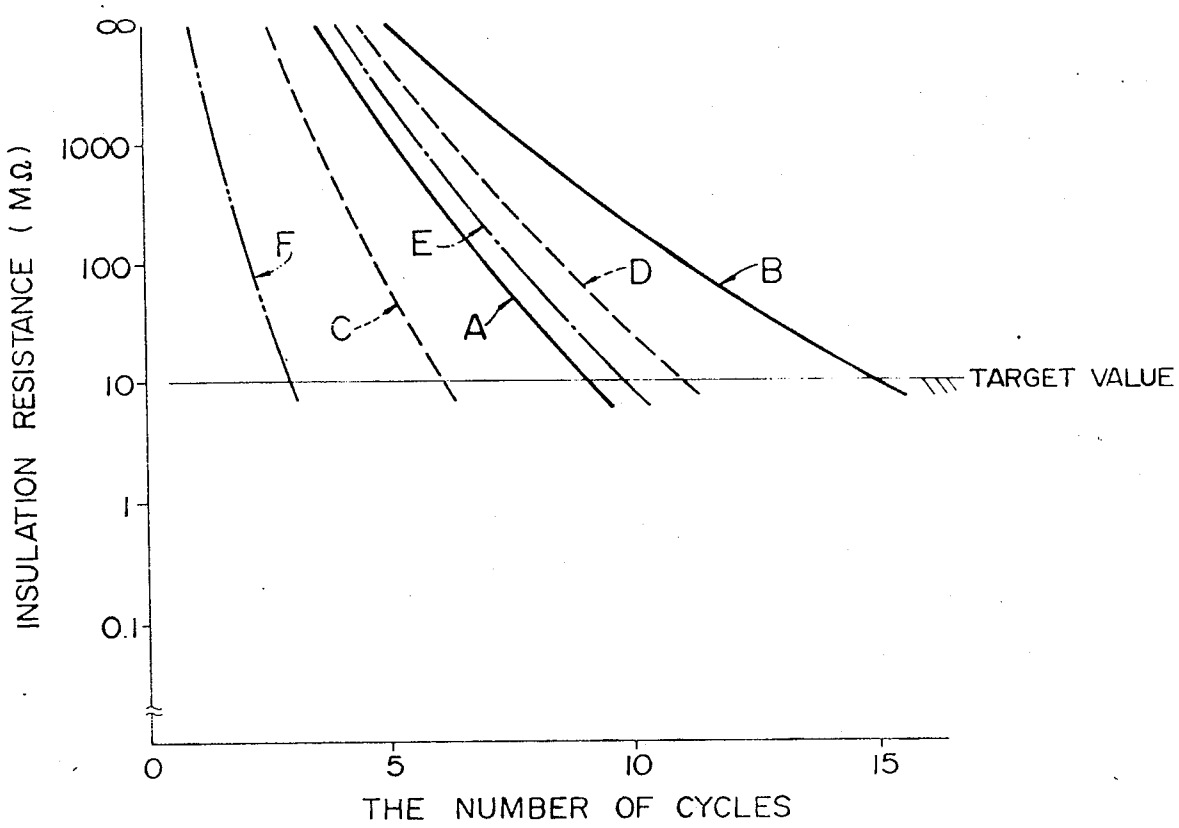
FIG. 5 is a graph comparatively illustrating values representative of contamination-proof capability of various sparking plug samples.

Test results are graphically illustrated in FIG. 5, clearly demonstrating that the sparking plug samples A and B of this invention having the coating layer formed of the mixed solution containing the silicone oil blended with the paraffin and ozokerite can be improved in contamination-proof capability in comparison with the corresponding comparative sparking plug samples C and D having the coating layer formed of the mixed solution containing the silicone oil blended with the paraffin alone. Further, it will be seen from FIG. 5 that for the same amount of coating (5 mg), the comparative sparking plug sample E having the coating layer formed of the silicone oil alone exhibits the most efficient contamination-proof capability, and that the comparative sparking plug sample F without the coating layer exhibits the worst contamination-proof capability.

It can therefore be concluded that as the coating amount of the coating layer and the percentage of the silicone oil increase, the improvement on the contamination-proof capability can be promoted. This means that in improving the contamination-proof capability the mixed solution of the invention containing the silicone oil added with the paraffin and ozokerite to suppress the fluidity of the silicone oil is advantageous over the mixed solution containing the silicone oil added with the paraffin alone to also suppress the fluidity of the silicone oil because when coated by the same amount, the former mixed solution can contain the silicone oil at a higher percentage than the latter mixed solution or the former mixed solution can contain the additive at a lower percentage than the latter mixed solution.

The sparking plug of the invention constructed as above can attain the following effects. More particularly, since the fluidity of the coating layer formed on the surface of the ceramic insulator leg is suppressed, the coating layer does not droop toward the spark gap of the sparking plug to form a bridge across the spark gap which would be carbonized and become electrically conductive in use, ultimately giving rise to a failure to ignite the sparking plug. In addition, the coating layer is less affected by the carbon contamination so as not to reduce its insulation resistance, thereby efficiently guarding the sparking plug against the contaminative damage, especially in a new car which is trained under a condition that the sparking plug tends to undergo vigorous carbon contamination.

I claim:

1. A sparking plug comprising:

a ceramic insulator holding a center electrode;

a metal body in which said ceramic insulator is fixedly housed; and a coating layer made of a mixed solution of silicone oil blended with a mixture of paraffin and ozokerite and formed on the surface of a leg of said ceramic insulator, said leg being surrounded by the inner surface, close to the combustion chamber, of said metal body.

2. A sparking plug according to claim 1 wherein said mixed solution contains 100 weight percent of silicone oil blended with paraffin by at least 5 weight percent and ozokerite by at least 0.2 weight percent.

3. A sparking plug according to claim 2 wherein said mixture contains 100 weight percent of paraffin mixed with ozokerite by 5 to 30 weight percent.

4. A sparking plug comprising:

a ceramic insulator holding a center electrode;

a metal body in which said ceramic insulator is fixedly housed; and a coating layer formed of a mixed solution containing 100 weight percent of silicone oil blended, by 10 to 30 weight percent, with a mixture of 100 weight percent of paraffin and ozokerite mixed thereto by 10 to 20 weight percent, said coating layer being formed on the surface of a leg of said ceramic insulator, said leg being surrounded by the inner surface, close to the combustion chamber, of said metal body.

5. A sparking plug comprising:

a ceramic insulator holding a center electrode;

a metal body in which said ceramic insulator is fixedly housed; and coating layers made of a mixed solution of silicone oil blended with a mixture of paraffin and ozokerite and respectively formed on the inner surface, close to the combustion chamber, of said metal body and the surface of a leg of said ceramic insulator, said leg being surrounded by said inner surface of said metal body.

6. A sparking plug according to claim 5 wherein said mixed solution contains 100 weight percent of silicone oil blended with paraffin by at least 5 weight percent.

7. A sparking plug according to claim 5 wherein said mixture contains 100 weight percent of paraffin mixed with ozokerite by 5 to 30 weight percent.

8. A sparking plug comprising:

a ceramic insulator holding a center electrode;

a metal body in which said ceramic insulator is fixedly housed; and coating layers formed of a mixed solution containing 100 weight percent of silicone oil blended, by 10 to 30 weight percent, with a mixture of 100 weight percent of paraffin and ozokerite mixed thereto by 10 to 20 weight percent, said coating layers being respectively formed on the inner surface, close to the combustion chamber, of said metal body and the surface of a leg of said ceramic insulator, said leg being surrounded by said inner surface of said metal body.

* * * * *